US008416974B2

(12) United States Patent
Ammitzboll et al.

(10) Patent No.: US 8,416,974 B2
(45) Date of Patent: Apr. 9, 2013

(54) HEARING AID WITH CONNECTING ELEMENT SERVING FOR RETENTION IN CONCHA

(75) Inventors: Knud Ammitzboll, Berkeley Heights, NJ (US); Mark Balke, Nürnberg (DE); Uwe Rass, Nürnberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 12/224,906

(22) PCT Filed: Oct. 4, 2007

(86) PCT No.: PCT/EP2007/060574

§ 371 (c)(1),
(2), (4) Date: Sep. 9, 2008

(87) PCT Pub. No.: WO2008/040795

PCT Pub. Date: Apr. 10, 2008

(65) Prior Publication Data

US 2009/0202094 A1 Aug. 13, 2009

(51) Int. Cl.
*H04R 25/00* (2006.01)

(52) U.S. Cl.
USPC ..... 381/324; 381/322; 381/328; 381/380; 181/135; 181/130; 181/129

(58) Field of Classification Search ..... 381/328, 381/324, 329, 361, 362, 366, 367, 368, 322, 381/380; 181/135, 130, 129
See application file for complete search history.

(56) References Cited

U.S. PATENT DOCUMENTS

| | | | | |
|---|---|---|---|---|
| 3,312,789 | A | 4/1967 | Lewis | |
| 3,783,201 | A | 1/1974 | Brander | |
| 5,048,090 | A * | 9/1991 | Geers | 381/328 |
| 7,164,775 | B2 * | 1/2007 | Meyer et al. | 381/322 |
| 7,340,075 | B2 * | 3/2008 | Bayer | 381/330 |
| 7,844,065 | B2 * | 11/2010 | von Dombrowski et al. | 381/328 |
| 7,916,884 | B2 * | 3/2011 | Kah, Jr. | 381/328 |
| 2005/0190939 | A1 | 9/2005 | Fretz | |
| 2009/0123010 | A1 | 5/2009 | Cano et al. | |

FOREIGN PATENT DOCUMENTS

| | | | |
|---|---|---|---|
| DE | 8328154 | U1 | 2/1984 |
| DE | 10 2005 008 319 | B3 | 8/2006 |
| JP | 60180200 | U | 11/1985 |
| JP | 2009542056 | A | 11/2009 |
| WO | WO 2007/014950 | A2 | 2/2007 |

* cited by examiner

*Primary Examiner* — Curtis Kuntz
*Assistant Examiner* — Amir Etesam

(57) ABSTRACT

A hearing aid device has a shell that fits into the upper part of the concha of the outer ear of a hearing-impaired person, and connecting element that is held in the concha of the outer ear and terminates in an ear piece in the ear canal. The combination of the shell and the connecting element in the concha retain the hearing aid in the outer ear.

18 Claims, 2 Drawing Sheets

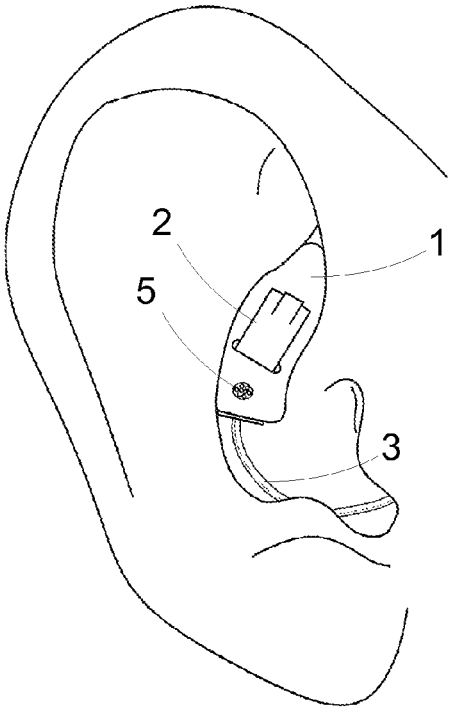
FIG. 1
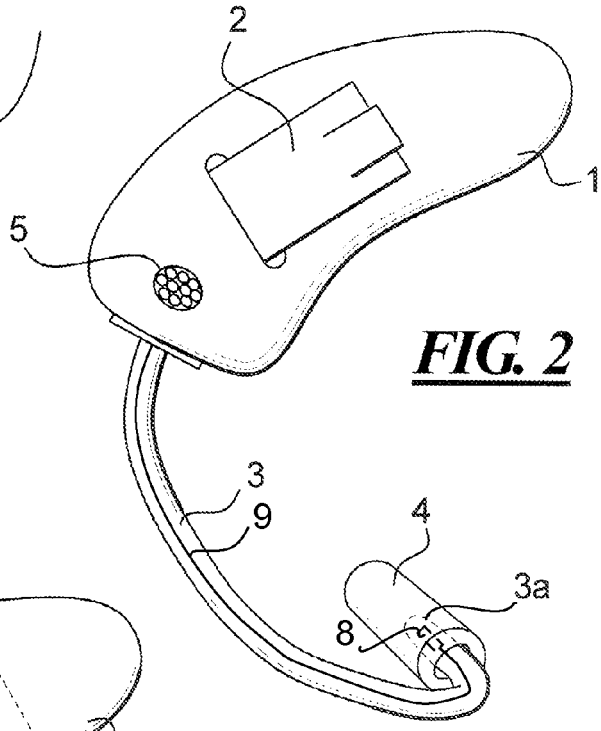
FIG. 2
FIG. 3
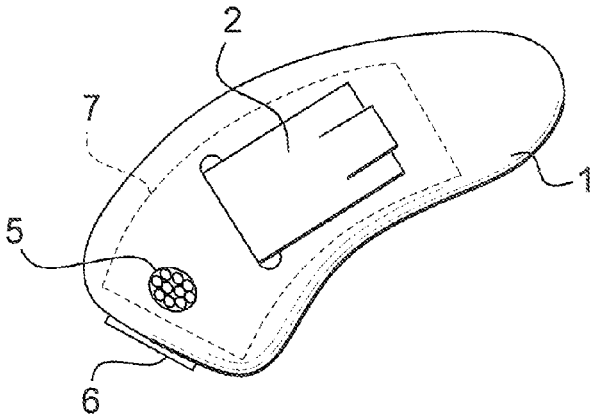
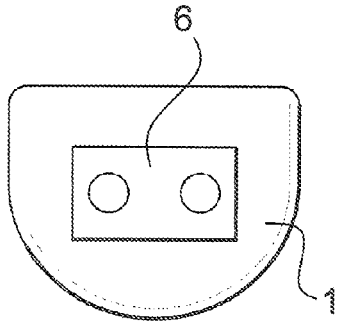
FIG. 4

HEARING AID WITH CONNECTING ELEMENT SERVING FOR RETENTION IN CONCHA

BACKGROUND

The present invention is concerned with a hearing-aid that conducts sound to the ear of a hearing-impaired person.

A conventional behind the ear (BTE) hearing aid has a small case or housing that fits behind the ear of a hearing-impaired person, and sound is conducted to the middle ear through an ear mold that is generally customized for the wearer of the hearing aid.

Another type of conventional category of hearing aids is the in-the-ear (ITE) hearing aid, which has a housing commonly called an otoplastic, that fits into the concha with a customized fit.

More recently developed hearing aids include in the canal (ITC), mostly in canal (MIC) and completely in the canal (CIC) hearing aids. These hearing aids are quite small, and generally occupy only the bottom half of the external ear (pinna). Generally, ITC hearing aids cannot be seen when directly facing the hearing-impaired person. MIC and CIC hearing aids are even smaller, and often are not visible unless one happens to look directly into the ear of the hearing-impaired person.

A further category of hearing aids that has recently become commercially available is the open-fit or over-the-ear (OTE) hearing aid. These devices have a behind-the-ear housing or case, but it is generally much smaller than a conventional BTE housing. An open fit hearing aid usually has a thin, transparent tube that proceeds into the ear canal. This tube terminates in the ear canal with an ear piece, preferably a small, resilient domed element, that is usually composed of silicone or acrylic material, and holds the tube in place. Sound is conducted into the ear canal via this tube. In a Receiver-In-Canal (RIC) design, the ear piece comprises the receiver and the tube is used to carry wires that are attached to the receiver, which sits wholly in the canal.

Open-fit hearing aids generally have been difficult to manufacture and have performance difficulties. These designs are particularly susceptible to feedback. Customized fit hearing aid designs however are particularly susceptible to the "occlusion effect", which is a plugged-up feeling experienced by the wearer in which the wearer hears his own voice as an echo. This is a major reason for hearing aid dissatisfaction and rejection.

German Utility Model DE 299 16-891 U1 shows a tinnitus masker or hearing aid with a slender housing bent in a C-shape. A lower end of the housing with a sound outlet hole extends into the auditory canal. The housing extends along the anthelix and the other end of the housing abuts the upper part of the concha.

SUMMARY

It is an object of the present invention to provide a hearing with wide design flexibility. It is an other object of the present invention to provide a hearing aid that makes use of the general RIC concept, but which avoids, or at least reduces, problems that have been associated with conventional devices making use of the RIC concept.

The overall hearing aid:

The above object is achieved in accordance with various embodiments of the present invention by a hearing aid that has a shell or housing, in which the electronics are contained. The shell sits in the upper part of the concha of the outer ear of a user. Further the hearing aid comprises an ear piece adapted to fit in the ear canal. The shell and the ear piece are connected by a tubular connecting element. The connecting element is composed of a material that, although somewhat flexible, has a sufficient rigidity to perform a retention function by placing pressure in the outer ear at the back of the concha. Different lengths of the connecting element can be made available in order to accommodate different ear sizes. The connecting element exits the canal aperture at the base of the ear, and is positioned under the antitragus and follows the contour of the concha. The hearing aid according to the invention provides a good wearing comfort. Preferably the ear canal is left wide open. A small and unobtrusive design is possible. The user can wear glasses independently from the hearing aid. The hearing aid according to the invention combines the advantages of ITE hearing aids with those of BTE hearing aids.

The shell:

The hearing aid includes a housing or shell that may be customized to fit the ear or may be made as universal fit component, also in various sizes such as small, medium, and large. Universally fitting shells may be mass produced. Customized shells are adapted to the individual shape of the ear of the user. Customized shells may have a size designed or selected to enable accurate selection of the correct connecting element length for the connecting element in an electronic detailing (e-detailing) and modeling software for computer aided manufacturing, using collision detection and part placement. The connecting element may comprise a plug with a plate for detachably connecting the connecting element to the shell. A recess for the plate can be integrated into a custom shell during the e-detailing and modeling process. The shell is positioned beneath the anthelix and abuts the anthelix and the upper part of the concha. The shell can extend into the helix lock area of the ear to ensure secure fitting thereof, and operates in combination with the connecting element to hold the overall hearing aid arrangement in place.

The ear piece:

In various embodiments of the invention, different kinds of ear pieces may be utilized. If the hearing aid makes use of the RIC concept, the ear piece comprises the receiver. Otherwise the receiver sits in the shell and a sound tube leads from the shell to the ear piece. The ear piece may be customized, that means adapted to the individual shape of the ear canal of a user, or fit universally. The ear piece may seal the ear canal, or alternately may let it be partially or wide open. Different types of ear pieces may also be possible if the receiver is positioned within the ear piece. Advantageously, a user-replaceable tip can be provided that directs sound into the ear. Thus, if the tip gets plugged with wax, the wearer can change it himself, thereby avoiding the cost and inconvenience of a factory repair.

The connecting element:

The tubular connecting element connects the ear piece to the shell. In an embodiment in which the receiver is positioned within the shell, the connecting element may be formed as a sound channeling mechanism such as a sound tube that pipes the sound from the receiver to the ear. In an embodiment in which the receiver is positioned within the ear piece, the tubular connecting element comprises wires for the electrical connection of the receiver to the electronics within the shell. Preferably, the connecting element is detachably connected to the shell or detachably connected to the ear piece or both of it. The connecting element can be connected to the shell and the electronics therein by a conventional plug, e.g. of the type used in a BTE hearing aid making use of the RIC concept. If a plug is used on at least one end of the connecting element, the plug may be shaped to perform a smooth transition from the connecting element to the shell or the ear piece, respectively. Preferably, the connecting element is a flexible tube. Preferably, the flexible tube has a diameter of less than 4 mm. Advantageously, the diameter of the flexible tube is even less than 2 mm. But also diameters between 2 and 4 mm are possible.

DESCRIPTION OF THE DRAWINGS

FIG. 1 is a pictorial view showing a hearing aid constructed in accordance with an embodiment of the present invention in place in the ear of a hearing-impaired person;

FIG. 2 is an enlarged pictorial illustration of the overall exterior appearance of an embodiment of the inventive hearing aid;

FIG. 3 is a pictorial illustration showing the customized shell by itself, with the electronics board being schematically illustrated therein;

FIG. 4 is an end view of the hearing aid of FIG. 3, showing a face plate for the connecting element.

DESCRIPTION OF THE PREFERRED EMBODIMENTS

Figure 5A:
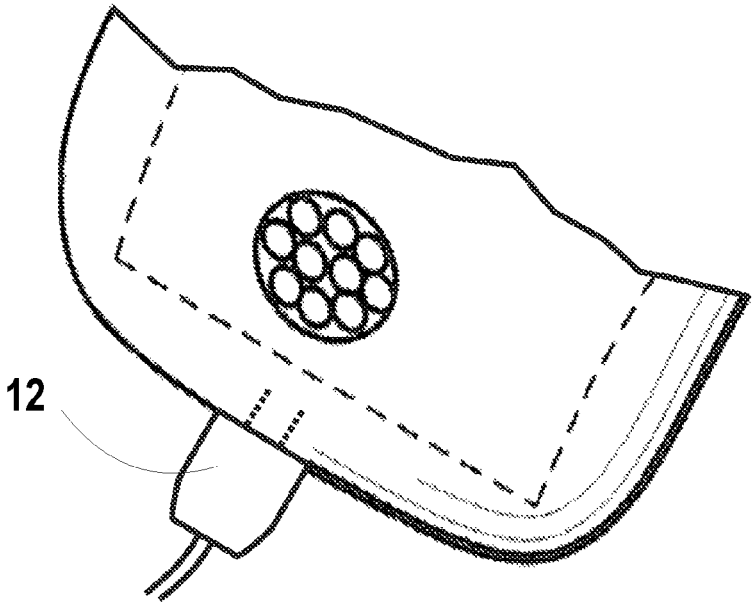
FIGS. 5A, B are pictorial illustrations of alternate embodiments of designs without a face plate.

FIGS. 1 and 2 show a hearing aid constructed in accordance with an embodiment of the present invention in place in the ear (FIG. 1) of a hearing-impaired person. The hearing aid includes a housing or shell 1 that may be customized to fit the individual ear of a user or may be made as universal fit components, preferably in various sizes such as small, medium, and large. The shell 1 is designed to preferably fit in the concha portion of the outer ear of the hearing-impaired person. A tubular connecting element 3 proceeds from the shell 1 into the ear canal of the hearing-impaired person.

The shell 1 extends into the helix lock area of the ear and the connecting element 3 proceeds through the concha, with these two components serving to retain the hearing aid in place in the outer ear, particularly during physical exertion. The connecting element 3 is ideally made of a flexible material allowing the connecting element to be an integral part of the device by placing pressure in the outer ear at the back of the concha.

As shown in more detail in FIGS. 1 and 2, the shell 1 has a battery door 2 and a microphone 5 for receiving incoming audio signals that are processed in a suitable manner by circuitry contained within the shell 1. In the embodiment as shown, in which a receiver 8 is positioned within the ear canal, the processed output signal is supplied to the hearing-impaired person via the connecting element 3, that terminates in an end 3*a* containing the receiver 8 covered by a domed element 4 (ear mold) that fits snugly in the ear canal. The receiver 8 is electrically connected to the processing circuitry located within the shell via wires 9, comprised by the connecting element 3.

In another embodiment in which the receiver 8 is positioned within the shell 1, the connecting element 3 may be formed as a sound channeling mechanism such as a sound tube that pipes the sound from the receiver to the ear. A similar domed element 4 may be provided that fits snugly in the ear.

Different lengths for the connecting element 3 can be selected so as to provide the appropriate retention properties for ears of different sizes. The connecting element 3 exits the canal aperture at the base of the ear and is positioned under the antitragus and then follow the contour of the concha bowl.

As shown in FIGS. 3 and 4, a face plate 6 may be disposed at one side of the shell 1 to interface with the connecting element 3. The face plate 6 can be a standard 10A CIC face plate. The entire connecting element 3 can be detached by the user and replaced, if necessary, which avoids sending the unit back to the factory for repair. In an alternate embodiment, only the end of the connecting element attached to the ear piece 3*a* is detachable by the user. In either case, the user detachable portion may be implemented by a plug and socket configuration, pins and holes, clips, or any other mechanism that does not involve cutting and soldering. FIG. 5A illustrates an embodiment in which a plug and socket 12 embodiment is utilized for the connecting element 3 at the shell 1. A similar plug and socket configuration could be utilized at the opposite end of the connecting element 3. Thus, the connecting element 3 may be user detachable at the shell end or at the ear piece end.

Figure 5B:
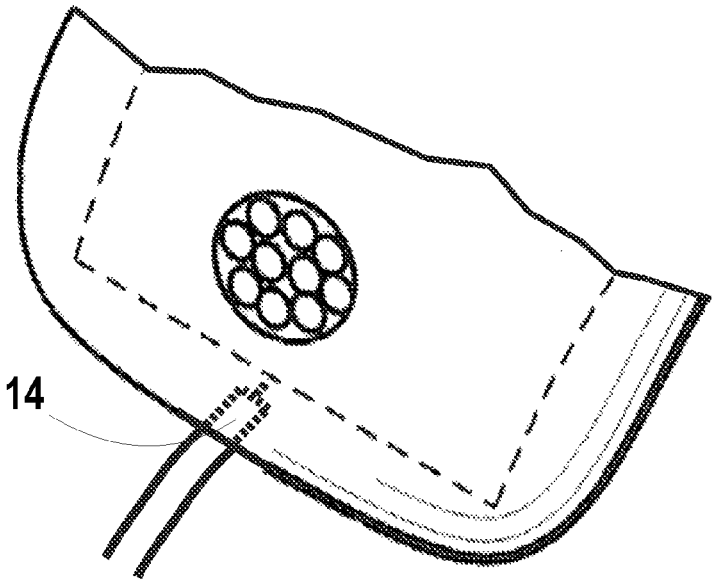

It should be noted that in an alternate embodiment, as illustrated in FIG. 5B, the connecting element 3 could integrate into the shell 1 without a face plate.

As schematically illustrated in FIG. 3, the shell 1 contains a circuit board 7 therein (or multiple, connected circuit boards), the components being placed within the shell 1. If shell 1 is a customized shell, the components are preferably positioned within the shell 1 using commercially available e-detailing and modeling software, so as to appropriately position the components within the interior of the customized shape of the shell 1. The e-detailing and modeling software embodies collision avoidance, so that when the components are physically mounted, they are all adequately separated from each other, but still fit within the customized shape of the shell 1.

In various embodiments of the invention, different kinds of ear pieces may be utilized. There may be a customized or universal fitting ear piece, which may seal the ear canal, or alternately may let it be partially or wide open. These different types of ear pieces may also be possible if the receiver is positioned within the ear piece.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The present invention may be described in terms of functional block components and various processing steps. Such functional blocks may be realized by any number of components configured to perform the specified functions. Furthermore, the present invention could employ any number of conventional techniques for mechanical and electronics configuration and the like.

The particular implementations shown and described herein are illustrative examples of the invention and are not intended to otherwise limit the scope of the invention in any way. For the sake of brevity, conventional aspects of the systems (and components of the individual operating components of the systems) may not be described in detail. Furthermore, the connecting lines, or connectors shown in the various figures presented are intended to represent exemplary functonal relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A hearing aid device comprising:

a shell having a shape adapted to fit in the upper part of the concha abuting the anthelix of an ear of a hearing-impaired person, comprising a receiver;

processing circuitry mounted within said shell that processes incoming audio signals to produce an audio output dependent on a hearing-impairment of the hearing-impaired person;

an ear piece adapted to fit in the ear canal of the ear of the hearing-impaired person; and a connecting element comprising a sound tube having a first end connected to the shell and a second end connected to the ear piece, said connecting element being adapted to snugly fit under an antitragus and follow a contour of a concha bowl of the ear and, in combination with said shell, exerting a pressure to retain the shell and the ear piece in said ear.

2. The hearing aid device as claimed in claim 1, wherein the connecting element is a flexible tube.

3. The hearing aid device as claimed in claim 2, wherein the flexible tube has a diameter of less than 4 mm.

4. The hearing aid device as claimed in claim 3, wherein the flexible tube has a diameter of less than 2 mm.

5. The hearing aid device as claimed in claim 1, wherein said connecting element is user detachable.

6. The hearing aid device as claimed in claim 5, wherein the connecting element comprises a plug and socket interface via which it connects to the shell.

7. The hearing aid device as claimed in claim 5, wherein the connecting element comprises a plug and socket interface via which it connects to the ear piece.

8. The hearing aid device as claimed in claim 1, wherein the shell is a customized shell adapted to the individual shape of the ear.

9. The hearing aid device as claimed in claim 1, wherein the shell is a universal fitting shell.

10. The hearing aid device as a claimed in claim 9, wherein the universal fitting shell is classified as either a small, medium, or large shell.

11. The hearing aid device as claimed in claim 1, wherein said shell comprises a battery door at a side of said shell that faces outwardly when the shell is disposed in the ear.

12. The hearing aid device as claimed in claim 1, wherein said shell comprises a microphone at a side of said shell that faces outwardly when the shell is disposed in the ear.

13. The hearing aid device as claimed in claim 1, wherein the ear piece is a customized ear piece.

14. The hearing aid device as claimed in claim 1, wherein the ear piece is a universal fitting ear piece.

15. The hearing aid device as claimed in claim 1, wherein the ear piece seals the ear canal.

16. The hearing aid device as claimed in claim 1, wherein the ear piece leaves the ear canal open.

17. The hearing aid device as claimed in claim 1 comprising a circuit board contained in said shell on which various processing circuitry is mounted, said circuit board and said processing circuitry having a shape and position conforming to an interior shape of said shell.

18. A hearing aid device comprising:

a shell having a shape adapted to fit in the upper part of the concha abuting the anthelix of an ear of a hearing-impaired person;

processing circuitry mounted within said shell that processes incoming audio signals to produce an audio output dependent on a hearing-impairment of the hearing-impaired person;

a receiver disposed within the shell;

an ear piece adapted to fit in the ear canal of the ear of the hearing-impaired person; and a connecting element having a first end connected to the shell and a second end connected to the ear piece, said connecting element configured as a sound channeling mechanism effective to convey sound from the receiver to the ear piece, the connecting element also being adapted to snugly fit under an antitragus and follow a contour of a concha bowl of the ear and, in combination with said shell, exerting a pressure to retain the shell and the ear piece in said ear.

* * * * *

UNITED STATES PATENT AND TRADEMARK OFFICE

CERTIFICATE OF CORRECTION

PATENT NO. : 8,416,974 B2
APPLICATION NO. : 12/224906
DATED : April 9, 2013
INVENTOR(S) : Ammitzboll et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 363 days.

Signed and Sealed this
Eighteenth Day of March, 2014

Michelle K. Lee

Michelle K. Lee
*Deputy Director of the United States Patent and Trademark Office*